United States Patent [19]

Kurtz et al.

[11] Patent Number: 5,014,456

[45] Date of Patent: May 14, 1991

[54] CARTRIDGE MAGAZINE FOR SEMI-AUTOMATIC FIREARMS

[75] Inventors: Robert L. Kurtz, Windsor, Conn.; Kevin G. Foley, Springfield; Kurt J. Hindle, South Hadley, both of Mass.

[73] Assignee: Smith & Wesson Corp., Springfield, Mass.

[21] Appl. No.: 467,414

[22] Filed: Jan. 19, 1990

[51] Int. Cl.[5] ..... F41A 9/65

[52] U.S. Cl. ..... 42/50

[58] Field of Search ..... 42/50, 7

[56] References Cited

U.S. PATENT DOCUMENTS

| | | | |
|---|---|---|---|
| 1,158,981 | 11/1915 | Carl | 42/50 |
| 3,711,981 | 1/1973 | Seecamp | 42/50 |
| 4,566,212 | 1/1986 | Chesnut | 42/50 |
| 4,805,333 | 2/1989 | Doria et al. | 42/50 |

FOREIGN PATENT DOCUMENTS

| | | | |
|---|---|---|---|
| 377840 | 8/1932 | United Kingdom | 42/50 |

*Primary Examiner*—Charles T. Jordan

*Attorney, Agent, or Firm*—Chapin, Neal & Dempsey

[57] ABSTRACT

Cartridge magazine for semi-automatic firearms has a base, side walls and a front and rear wall. The front wall has an opening at its upper end for the feeding of cartridges into the chamber of the firearm. The magazine includes a spring and a spring follower which feeds the cartridges upwardly toward the feed lips on the upper edge of the side walls of the magazine. A guide member extends inwardly from opposed sidewall portions of the magazine to engage the extractor groove of the cartridge being advanced toward the feed lips. Each guide member is formed by die lancing the side walls of the magazine at a distance from the feed lips greater than the cartridge radius, but less than the diameter thereof. Each member has an upright edge portion disposed at an oblique angle to the real wall of the magazine such that it is generally perpendicular to the axis of the cartridges being fed by the magazine spring follower. The member serves to retain the uppermost cartridge toward the rear wall of the magazine to prevent forward movement imparted by recoil and, where necessary, to cam the penultimate cartridge rearwardly as it is being fed toward the feed lips by the magazine spring follower.

4 Claims, 2 Drawing Sheets

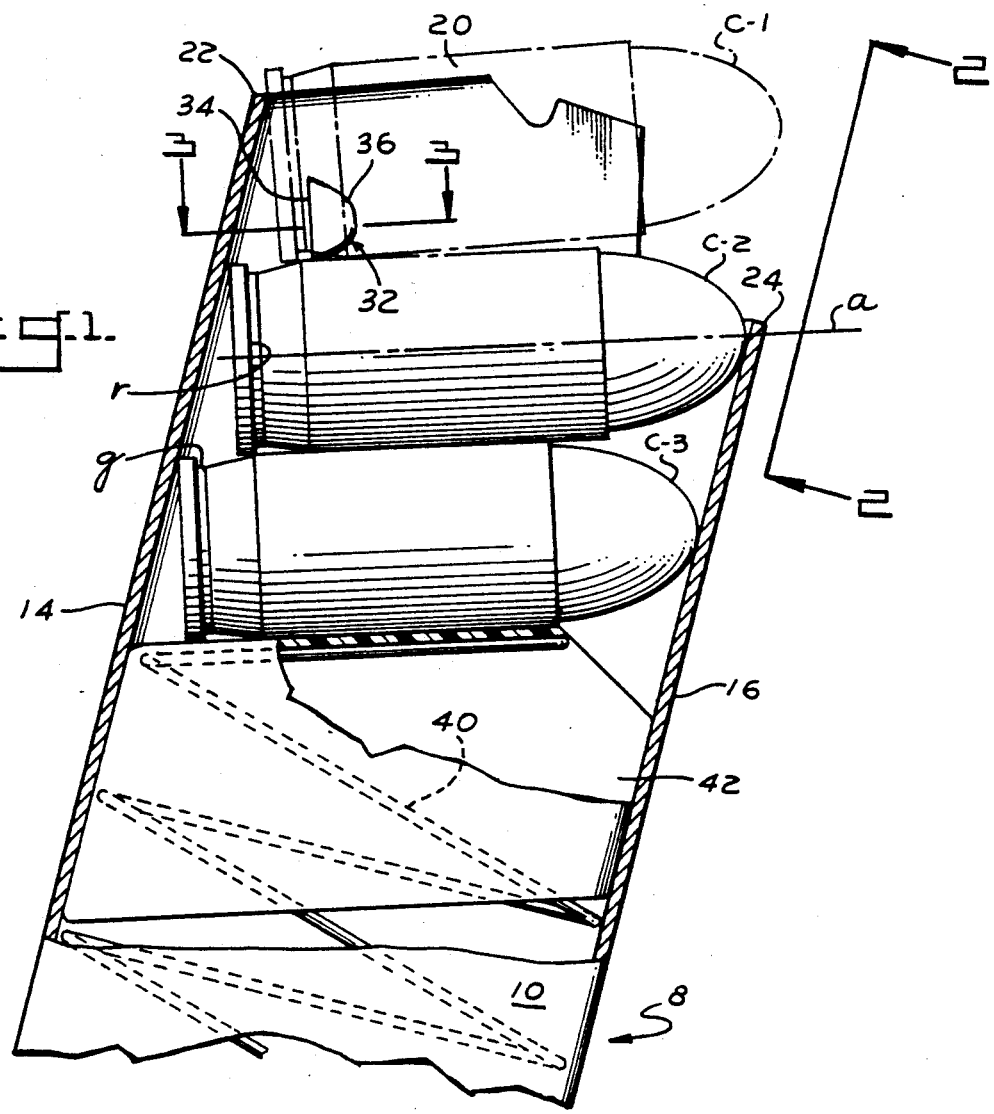
Fig. 1.
Fig. 2.
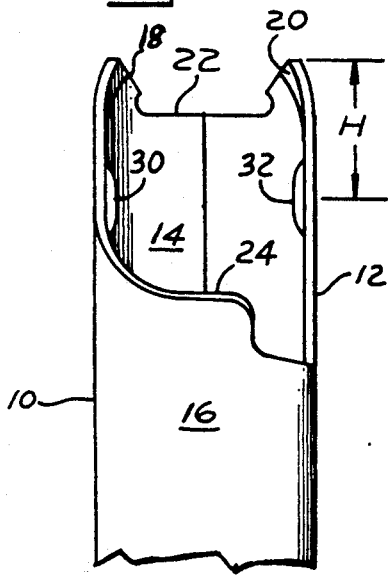
Fig. 3.
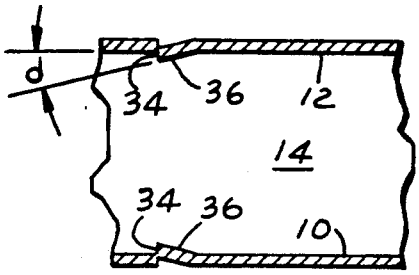

CARTRIDGE MAGAZINE FOR SEMI-AUTOMATIC FIREARMS

BACKGROUND OF THE INVENTION

This invention relates to magazines for semi-automatic firearms characterized by heavy recoil, such as 0.45 caliber and 9 mm pistols and, more particularly, to improvements in such magazines for accurately guiding or controlling the cartridge being fed by the spring follower to the uppermost position in the magazine.

With the advent, in recent years, of more compact high powered handguns, such as 0.45 caliber, 9 mm and 10 mm semi-automatic pistols, incidences of cartridge feed malfunctioning or jamming have markedly increased. It has been postulated that this problem is caused, during recoil of the gun, by increased velocity of the slide which, upon impacting against the frame, results in greater inertia being imparted to the cartridges carried in the magazine. The result is that the cartridges tend to shift forward in the magazine such that the uppermost cartridge may not be properly oriented for accurate feeding into the bore of the gun.

Although this particular problem has not been addressed, suggestions are found in the prior art of controlling the feed of the upper cartridge from the magazine into the chamber or bore of the firearm. U.S. Pat. No. 1,158,981 to Carl discloses the use of a pair of parallel, laterally spaced arms 21 to engage the body of the cartridge to guide the longitudinal movement thereof forward of the feed lips or flanges 31 into the bore. These arms do not, however, serve to guide or control the vertical upward movement of the cartridges within the magazine, as is accomplished by this invention.

U.S. Pat. No. 3,711,981 to Seecamp discloses a box-magazine provided with integral knock-out fingers 14 which have inwardly bent projections 15 which are adapted to engage the extractor grooves of all the cartridges in the magazine to prevent soft-nosed bullets being damaged by impacting against the front wall of the magazine because of recoil. While Seecamp deals with the problem of damage to the soft-nosed bullets, this invention relates to controlling the position or upward movement of the one cartridge being fed to the uppermost position in the magazine for accurate introduction into the bore of the firearm.

It is the principal object of this invention to provide a simple, effective, durable and form-stable guide member which projects inwardly from each of opposed sidewall portions of the magazine to control and hold the uppermost cartridge against inertial forward motion imparted by recoil and to guide the upward movement of cartridges to the uppermost position in the magazine by engagement with the extractor groove of the cartridge advancing from the penultimate to the uppermost position.

It is another object of this invention to form the guide members, as above-described, by lancing but not cutting through the side walls of the magazine to form guide members, each having an upright, rear edge portion and tapered inner surface portion comparable to the cross-section of the cartridge extractor groove.

It is a further object of this invention to provide a guide member of the above type in which the rear edge portion of the guide member is disposed at an oblique angle in the magazine to serve as a cam surface for corrective rearward movement of cartridges advancing vertically in engagement therewith.

The above and other objects of this invention will be more apparent from the following description read in conjunction with the accompanying drawings in which:

FIG. 1 is a side elevational view, partly in section, of a magazine which embodies this invention;

FIG. 2 is a front elevational view of the magazine;

FIG. 3 is a section taken along line 3—3 of FIG. 1, and

Figure 4:
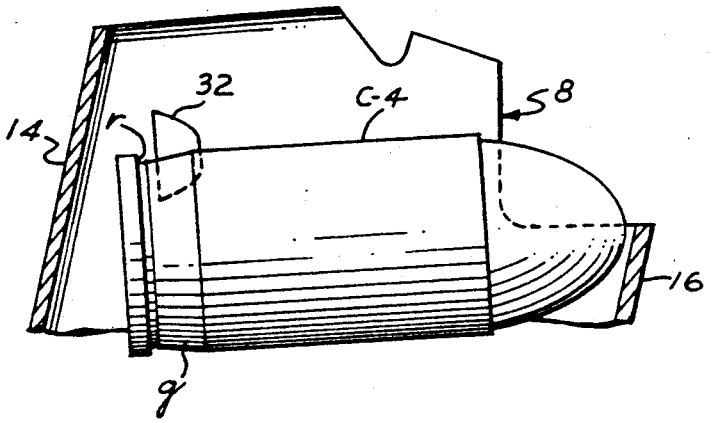
FIGS. 4–9 are schematic representations showing the feed sequence of a cartridge in the magazine.
Figure 5:
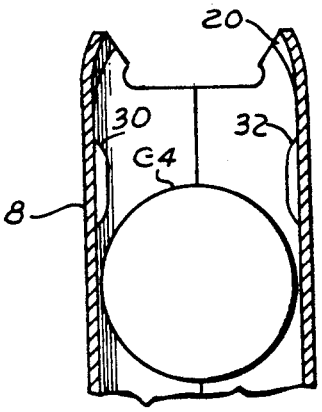

Referring in detail to the drawings, a magazine is illustrated generally at 8 in FIG. 1. The magazine, which may be formed of metal or molded plastic, comprises a box-like container of rectangular cross-section for holding and advancing, in sequence, a vertical stack of cartridges identified as C-1–C-3 adapted to be fed into the bore or chamber of a semi-automatic handgun (not shown). While this invention is illustrated in a single stack magazine, it is also adaptable to a double stack magazine in which the vertical stacks of cartridges are disposed in staggered side-by-side relationship.

The magazine 8 comprises side walls 10 and 12, a rear wall 14 and front wall 16. At the lower end, the magazine has a removable closure plate (not shown) and at its upper end is "open", with both side walls curved inwardly to form feed lips 18 and 20 (FIG. 2). The feed lips are adapted to hold a cartridge at the proper orientation to be fed into the bore of the gun. The rear wall 14 of the magazine includes, at its upper edge, a cutout 22 to provide access for movement of the pistol slide 33 (FIG. 6) to feed the top round into the gun bore. The upper edge portion of front wall 16 also includes a cutout 24 of sufficient depth to provide adequate clearance for rotation of the upper round from a nose-down attitude for feeding into the gun bore.

Figure 6:
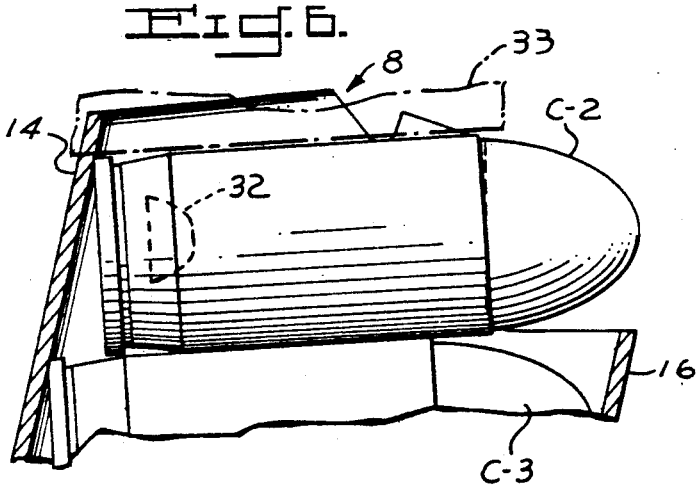
Figure 7:
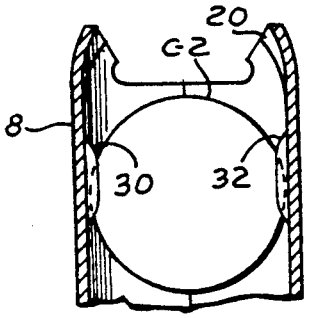

The magazine 8 is provided with means 30 and 32 to hold or retain the round against undesirable forward movement, such as may be caused by recoil, when it has been moved to its uppermost position, as depicted in FIGS. 6 and 7. The guide means also serve to guide the penultimate cartridge, or round C-2 (FIG. 1) as it is moved upwardly (FIGS. 6–9) in the magazine. Additionally, if there are any short rounds used in the magazine which, as depicted at C-4 in FIG. 4 may have shifted forwardly, the control means will also serve to cam or guide such a short round rearwardly as it moves past means 30 and 32 toward its uppermost position in the magazine.

The control and guide means embodying this invention comprises a pair of camguide members 30 and 32 which extend inwardly from opposed inner surfaces of side walls 10 and 12, respectively. The guide members 30 and 32 are identical and, as best illustrated in FIG. 1, each has a generally trapezoidal shape with a rectilinear outer, or back, edge portion 31 and an inner portion 36 which tapers to the plane of the side wall surface (FIG. 3). The guide members may be simply lanced into a metal magazine by a die which displaces but docs not cut through the magazine metal. By this technique, upright, rear edge portions 34 of sufficient height are generated to engage the extractor groove or rim of the cartridge being fed therepast by the spring follower 40. It will be recognized that the edge portions 34 (FIG. 3) of guide members 30 and 32 are not separated from the side wall metal and are reinforced or backed by displaced metal portions 36 of substantial scope disposed in the plane behind working edges 34. Since the guide members 30 and 32, as best depicted at d in FIG. 3, are formed by a lancing die which obliquely displaces a portion of the metal, the guide members will be characterized by much greater structural strength and form-stability than in the case of projections formed by cut-outs which are attached only at their inner ends as in the Seecamp patent, for example. In a plastic magazine, the guide members may be integrally molded with the magazine housing.

Figure 8:
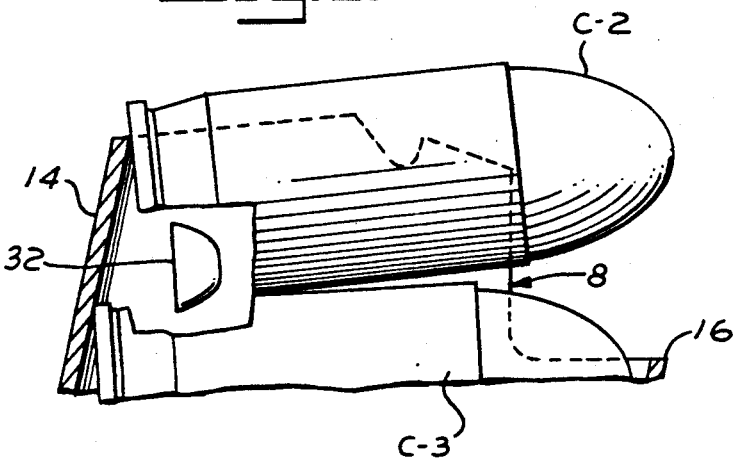
Figure 9:
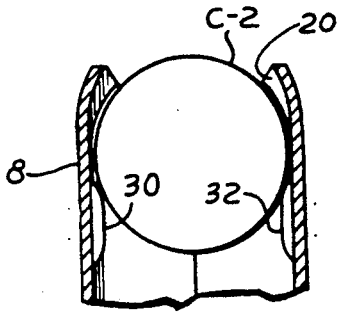

The guide members are each located adjacent the rear wall 14 and at a height H approximately midway between the upper edge of cutout 24 in front wall 16 and the corresponding edge of rear wall cutout. This height would also be greater than the radius of the cartridges, but less than their diameter so as to engage the top round to prevent its movement, as depicted in FIGS. 6 and 7, and yet release the round when it has moved upwardly, as shown in FIGS. 8 and 9.

The location of each member 30 and 32 is further defined by its rear edge portion 34 being disposed at an oblique angle to the rear wall 14 and spaced therefrom at a distance approximately equal to the longitudinal dimension of the extractor groove g measured from the forward surface of flange or rim r so that the control member will serve to retain the upper round C-2 (FIGS. 6 and 7) with its rim r contiguous to the rear wall 14 of the magazine. It is also an important feature in the case of the short round C-4 which, as depicted in FIG. 4, will have a tendency, because of recoil, to shift forward in the magazine, that such rounds be guided or cammed rearward toward the rear wall 14 as the groove g is engaged by members 30 and 32. Moreover, the round C-4 will be retained in that rearward position despite impact of the slide on the frame caused by heavy recoil. The rear edge portion 34 of each guide member in the illustrated embodiment is disposed at an oblique angle to the rear wall 14 so that it is generally perpendicular to the longitudinal axis a of the cartridges carried by magazine spring follower 42 (FIG. 1).

The principal function of the members 30 and 32 is to control the uppermost round C-2 (FIG. 1) so that after it clears the top edge 24 of front wall 16, it will be prevented from moving forward in the magazine 8 because of inertial force caused by recoil. This function is clearly depicted in FIGS. 6 and 7 wherein round C-2 is shown as being slightly below the magazine feed lips 18 and 20 being held there by the slide 33 of the gun in its forward position. In this condition, upon firing the round in the chamber, the resulting recoil could cause the round C-2 to move forwardly were it not for guide members 30 and 32 engaged with the rim r of the cartridge. The guide members thus positively prevent such an undesirable forward cartridge movement whereas, if unrestrained, the upper round could move forward so that it would not be properly oriented by the feed lips 18 and 20 for accurate feeding into the gun bore.

In addition to the advantages of controlling the cartridges during feeding of rounds during firing, this invention has the further advantage of overcoming the problem of the magazine jamming or binding in the well of the gun, such as when the top round has been displaced forwardly and engages the well wall. Because the guides 30 and 32 ensure that the top round C-2 (FIG. 1) will always be properly presented to the feed lips 18 and 20, the magazine 8 may be readily dropped or removed from the gun by simply pressing the magazine catch release button. This invention thus overcomes both the dynamic problems of cartridge feeding and resultant jamming of the action and the static problem of magazine removal.

Having thus described my invention, what is claimed is:

1. In a cartridge magazine for firearms having a generally rectangular cross-section, open at the top and defined by a pair of laterally-spaced side walls, a front wall having a cutout which defines the upper edge thereof and provides for cartridge feed therethrough, a rear wall and a coil spring follower for vertically advancing cartridges to be fed longitudinally in sequence into the bore of the firearm, each of the cartridges includes an extractor groove defined by an outwardly tapered conical surface which extends from the forward surface of the rear flange to the adjacent edge of the cylindrical surface of the cartridge casing, an improvement in said magazine comprising an inwardly extending guide member on each of said side walls disposed at a level medically of the upper edges of the rear wall and of the cutout of the front wall, each of said guide members having its maximum inward dimension disposed adjacent the rear wall of the magazine and being tapered outwardly from that dimension toward the front wall of the magazine to conform generally to the taper of the extractor groove, each of said guide members being adapted to engage the extractor groove of the penultimate cartridge in said magazine to hold the same against longitudinal movement toward said cutout as may be caused by recoil, and if necessary, to cam said penultimate cartridge toward the rear wall of the magazine as it is advanced by the follower to the uppermost position in the magazine.

2. In a cartridge magazine for firearms, the improvement as set forth in claim 1, in which said guide member is formed by lancing the side wall of the magazine, but without cutting through the metal thereof and in which the maximum inward dimension of said member defines a generally rectangular, upright edge portion thereof which is disposed adjacent to and spaced from the rear wall of the magazine.

3. In a cartridge magazine for firearms, the improvement as set forth in claim 2, in which the upright edge and the tapered portions of each member are adapted to engage the extractor groove of a cartridge spaced forwardly of the rear wall of the magazine to cam the cartridge toward the rear wall of the magazine as it is advanced to the uppermost position in the magazine.

4. In a cartridge magazine for firearms, the improvement as set forth in claim 3, in which said upright edge portion of each of the guide members is disposed generally perpendicular to the longitudinal axes of cartridges carried by the magazine spring follower.

* * * * *